US008298021B2

(12) United States Patent
Huang et al.

(10) Patent No.: US 8,298,021 B2
(45) Date of Patent: Oct. 30, 2012

(54) CONTACTING TERMINAL

(75) Inventors: Cheng-Qiang Huang, Taipei (TW); Bing-Tao Yang, Taipei (TW); Yin-Lung Wu, Taipei (TW); Ming-Chiang Chen, Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 155 days.

(21) Appl. No.: 12/940,030

(22) Filed: Nov. 4, 2010

(65) Prior Publication Data

US 2012/0115374 A1 May 10, 2012

(51) Int. Cl.
*H01R 4/48* (2006.01)

(52) U.S. Cl. ..... 439/862; 439/500

(58) Field of Classification Search ..... 439/862, 439/500

See application file for complete search history.

(56) References Cited

U.S. PATENT DOCUMENTS

| | | | | |
|---|---|---|---|---|
| 6,551,149 | B2 * | 4/2003 | Orihara | 439/862 |
| 7,131,875 | B2 * | 11/2006 | Kodaira et al. | 439/862 |
| D555,095 | S * | 11/2007 | Ho | D13/133 |
| D627,304 | S * | 11/2010 | Huang et al. | D13/154 |
| 8,070,498 | B2 * | 12/2011 | Shen | 439/66 |
| D660,249 | S * | 5/2012 | Chen et al. | D13/154 |

* cited by examiner

*Primary Examiner* — Xuong Chung Trans
(74) *Attorney, Agent, or Firm* — Lin & Associates IP, Inc.

(57) ABSTRACT

A contacting terminal electrically connecting with an electrical element includes a soldering plate, a pair of facing confining plates extended upward from two opposite side edges of the soldering plate, an upward flexible arm extended from one end of the soldering plate, and a contacting portion extended from a free end of the flexible arm and beyond tops of the confining plates. The contacting portion is elastically pressed downward by the electrical element to realize an electrical connection therebetween and restricted between the confining plates. Tops of the confining plates are capable of stopping the electrical element pressing the contacting portion downward excessively.

9 Claims, 4 Drawing Sheets

CONTACTING TERMINAL

BACKGROUND OF THE INVENTION

1. Field of the Invention

The present invention relates to a terminal, and particularly to a contacting terminal having a structure to constrain the movement of a contacting portion of the contacting terminal.

2. The Related Art

Referring to FIG. 1, a conventional contacting terminal 100' has a soldering plate 10'. A free end of the soldering plate 10' is extended and bent upwards to form a lying-U shaped flexible arm 20'. A distal end of the flexible arm 20' extends upward and arches opposite to the soldering plate 10' to form a contacting portion 30'. Middles of side edges of the soldering plate 10' extend upward and are bent toward each other to form two inverted L-shaped confining arms 40'. When the contacting terminal 100' is in the state of freedom, the distal end of the flexible arm 20' is abutting against bottoms of free ends of the confining arms 40'. The contacting terminal 100' is used to electrically connect with an electrical element (not shown) by means of the contacting portion 30' elastically abutting against the electrical element.

However, since the contacting terminal 100' has no structures to effectively constrain the downward movement of the electrical element abutting against the contacting terminal 100', the flexible arm 20' of the contacting terminal 100' is apt to deform when the contacting portion 30' is excessively compressed by the electrical element.

SUMMARY OF THE INVENTION

Accordingly, an object of the present invention is to provide a contacting terminal electrically connecting with an electrical element. The contacting terminal includes a soldering plate, a pair of facing confining plates extended upward from two opposite side edges of the soldering plate, an upward flexible arm extended from one end of the soldering plate, and a contacting portion extended from a free end of the flexible arm and beyond tops of the confining plates. The contacting portion is elastically pressed downward by the electrical element to realize an electrical connection therebetween and restricted between the confining plates. Tops of the confining plates are capable of stopping the electrical element pressing the contacting portion downward excessively.

As described above, since the contacting terminal has the confining plate to stopping the electrical element pressing the contacting portion downward excessively, such structures can avoid the deformation of the flexible arm as the contacting portion is excessively compressed by the electrical element.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
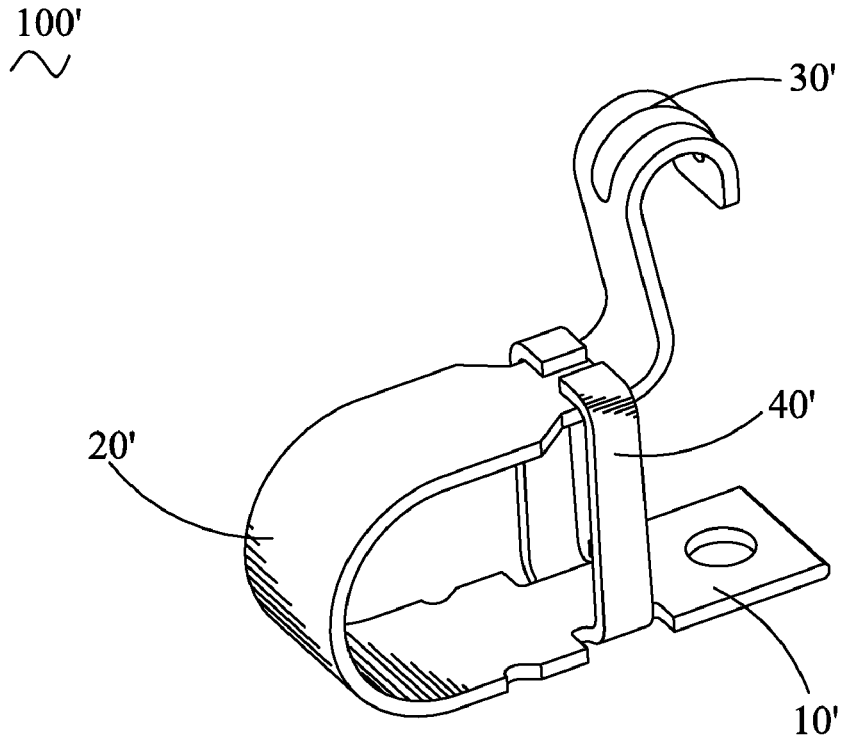
FIG. 1 is a perspective view of a contacting terminal in accordance with the prior art.
Figure 2:
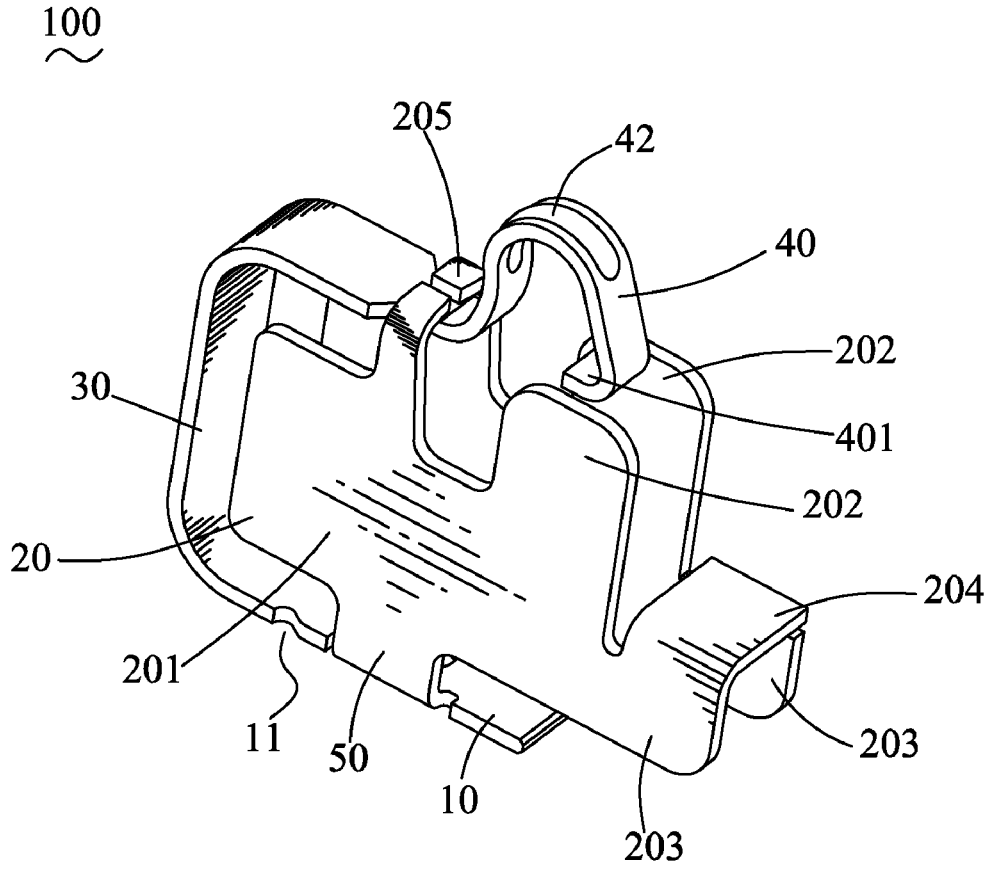
FIG. 2 is a perspective view of a contacting terminal of an embodiment in accordance with the present invention.
Figure 4:
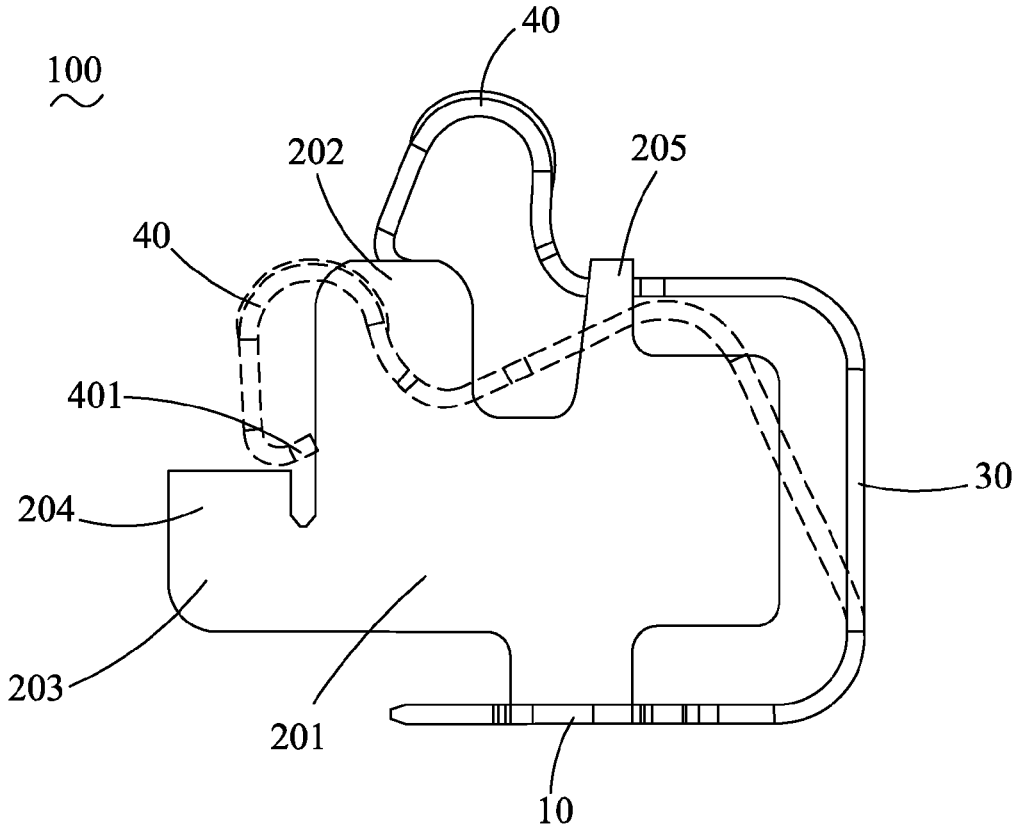
FIG. 4 is a lateral view showing the contacting terminal of FIG. 2 varying from a freedom state to a working state.

Referring to the drawings in greater detail, and first to FIG. 2 and FIG. 4, the embodiment of the invention is embodied in a contacting terminal 100. The contacting terminal 100 electrically connecting with an electrical element (not shown) includes a strip-shaped soldering plate 10. A pair of facing confining plates 20 extend upward from two opposite side edges of the soldering plate 10 and parallel with each other. An upward flexible arm 30 which is substantially lying-U shape extends from one end of the soldering plate 10. A contacting portion 40 extends from a free end of the flexible arm 30 and beyond tops of the confining plates 20. The contacting portion 40 is formed by means of the free end of the flexible arm 30 extending and being arched opposite to the soldering plate 10. A lower end of the contacting portion 40 forms a resisting portion 401. The contacting portion 40 has a rib 42 protruded opposite to the soldering plate 10 and across an apex thereof. The confining plate 20 includes a base plate 201 and a stopping plate 202 extended upward from a rear of a top of the base plate 201 for stopping the electrical element pressing the contacting portion 40 downward excessively. Lower portions of rears of the base plates 201 extend rearward to form two extending plates 203. A top of one of the extending plates 203 is extended and bent inward to form a supporting plate 204 with a free end supported on the other extending plate 203 for supporting the resisting portion 401 of the contacting portion 40. A pair of restricting arms 205 shown in substantial L-shape is extended upward and bent toward each other from the substantial middle portion of the base plate 201, the free end of the flexible arm 30 which is connected with the contacting portion 40 is restricted under the restricting arms 205. Tops of the restricting arms 205 are substantially at the same plane with the tops of the stopping plates 202. A connection portion 50 connects middles of the confining plate 20 and the corresponding side edge of the soldering plate 10.

Referring to FIG. 2 and FIG. 3 again, a substantial middle portion of each side edge of the soldering plate 10 opens a gap 11 located between the connecting portion 50 and the flexible arm 30.

Figure 3:
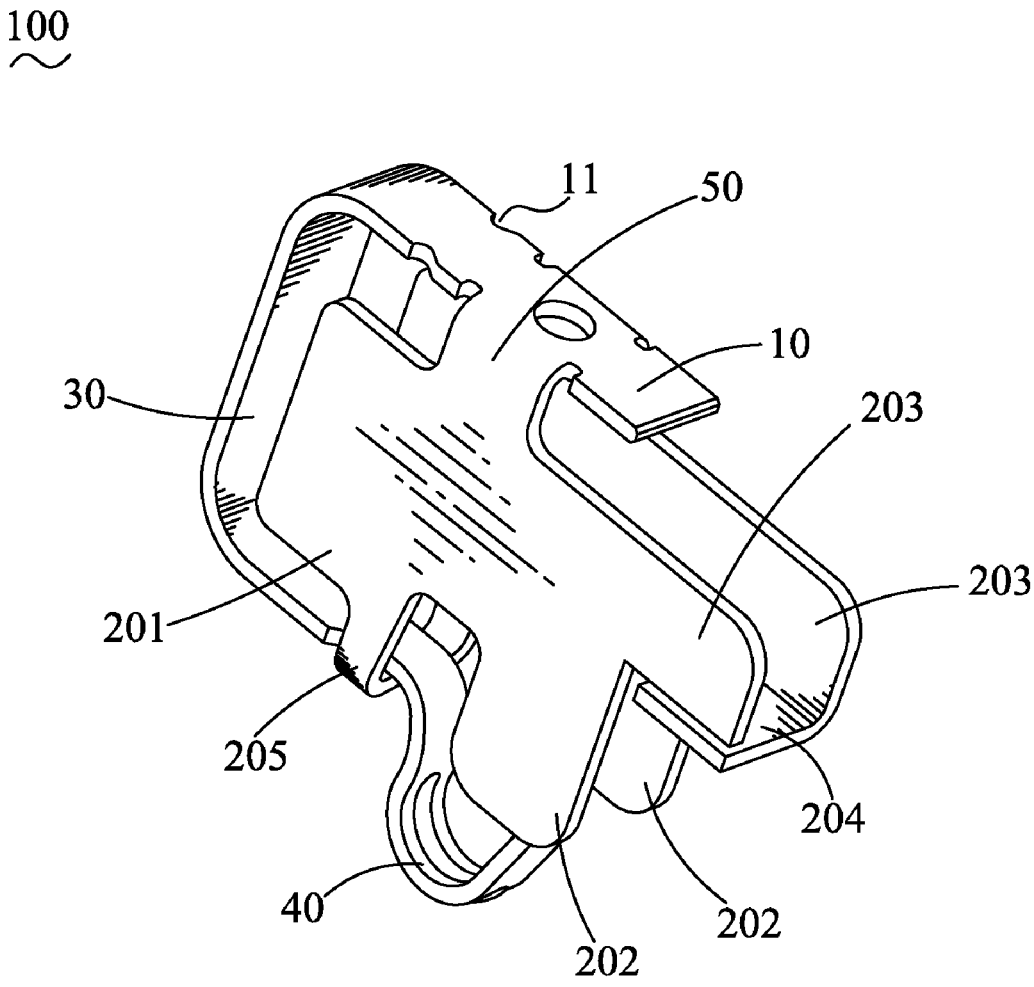
FIG. 3 is a perspective view of the contacting terminal of FIG. 2 viewed from another angle.

Referring to FIGS. 2-4, the contacting terminal 100 is mounted on a printed circuit board (not shown) by means of soldering the soldering plate 10 with the printed circuit board. Since the soldering plate 10 has the gaps 11, the excessive melting lead would accumulate in the gaps 11 for avoiding the excessive melting lead spreading on the flexible arm 30 when the soldering plate 10 is soldered with the printed circuit board. When the contacting terminal 100 is at the state of freedom, the free end of the flexible arm 30 is restricted under the restricting arms 205. The contacting portion 40 exposes beyond tops of the confining plates 20 for contacting with the electrical element, with the resisting portion 401 being restrained between tops of two stopping plates 202. When the electrical element abuts against the rib 42 of the contacting portion 40, the contacting portion 40 would move toward the soldering plate 10 and project into the space between two confining plates 20, the flexible arm 30 would be restrained between two confining plates 20 as well. Such structures of the contacting terminal 100 with two confining plates 20 can avoid the flexible arm 30 and the contacting portion 40 excessively biasing toward a side to assure the stable connection between the electrical element and the contacting terminal 100. When the contacting terminal 100 is working at the utmost state, the electrical element would be stopped by the stopping plates 202 and the restricting arms 205 to avoid the electrical element from excessively pressing the contacting portion 40 to deform the flexible arm 30. As the flexible arm 30 is capable of returning to the initial position under the elastic force of the flexible arm 30, the contacting portion 40 would abut against the electrical element all the time to assure the stable connection between the electrical element and the contacting terminal 100. Meanwhile, the resisting portion 401 of the contacting portion 40 is blocked by the supporting plate 204 to further ensure the stable connection between the electrical element and the contacting terminal 100.

As described above, since the contacting terminal 100 has the stopping plate 202 and the restricting arm 205, such structures can avoid the deformation of the flexible arm 30 as the contacting portion 40 is excessively compressed by the electrical element. Furthermore, the resisting portion 401 of the contacting portion 40 is blocked by the supporting plate 204 to further ensure the stable connection between the electrical element and the contacting terminal 100.

The foregoing description of the present invention has been presented for the purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A contacting terminal for electrically connecting with an electrical element, comprising:

a soldering plate;

a pair of facing confining plates extended upward from two opposite side edges of the soldering plate;

an upward flexible arm extended from one end of the soldering plate; and a contacting portion extended from a free end of the flexible arm and beyond tops of the confining plates, a lower end of the contacting portion forming a resisting portion, lower portions of rears of the confining plates extending rearward to form two extending plates, a top of one of the extending plates being extended and bent inward to form a supporting plate with a free end supported on the other extending plate for supporting the resisting portion;

wherein when the contacting portion is elastically pressed downward by the electrical element to realize an electrical connection therebetween and restricted between the confining plates, tops of the confining plates are capable of stopping the electrical element from pressing the contacting portion downward excessively.

2. The contacting terminal as claimed in claim 1, further comprising a connecting portion connecting middles of the confining plate and the side edge of the soldering plate.

3. The contacting terminal as claimed in claim 1, wherein the confining plate includes a base plate extended from the soldering plate and a stopping plate extended upward from a rear of a top of the base plate for stopping the electrical element from pressing the contacting portion downward excessively.

4. The contacting terminal as claimed in claim 3, wherein the contacting portion is formed by means of the free end of the flexible arm extending and then being arched opposite to the soldering plate.

5. The contacting terminal as claimed in claim 4, wherein a lower end of the contacting portion is lower than the tops of the stopping plates and located between the stopping plates.

6. The contacting terminal as claimed in claim 3, wherein a pair of restricting arms is extended towards each other from substantial middle portions of the base plates, and the free end of the flexible arm is restricted under the restricting arms.

7. The contacting terminal as claimed in claim 6, wherein the restricting arm is extended upward and then bent toward each other to show substantially L-shape.

8. The contacting terminal as claimed in claim 6, wherein tops of the restricting arms is substantially at the same plane with the tops of the stopping plates.

9. The contacting terminal as claimed in claim 1, wherein the flexible arm is substantially lying-U shape.

* * * * *